US010006730B1

(12) United States Patent
Pikielny

(10) Patent No.: US 10,006,730 B1
(45) Date of Patent: Jun. 26, 2018

(54) ADJUSTABLE MAGAZINE WELL

(71) Applicant: Dov Pikielny, Herzlia (IL)

(72) Inventor: Dov Pikielny, Herzlia (IL)

( * ) Notice: Subject to any disclaimer, the term of this patent is extended or adjusted under 35 U.S.C. 154(b) by 0 days. days.

(21) Appl. No.: 15/679,288

(22) Filed: Aug. 17, 2017

(51) Int. Cl.
*F41A 9/71* (2006.01)

(52) U.S. Cl.
CPC ..... *F41A 9/71* (2013.01)

(58) Field of Classification Search
CPC ..... F41A 9/24; F41A 9/25; F41A 9/37; F41A 33/00
USPC ..... 42/7, 6
See application file for complete search history.

(56) References Cited

U.S. PATENT DOCUMENTS

| | | | | |
|---|---|---|---|---|
| 5,566,488 | A * | 10/1996 | Yap | F41A 9/71 42/49.02 |
| 8,898,946 | B1 * | 12/2014 | Johnson | F41A 17/36 42/49.02 |
| 2017/0138685 | A1 * | 5/2017 | Beasley | F41A 9/71 |
| 2017/0307319 | A1 * | 10/2017 | Jarboe | F41A 9/71 |
| 2017/0356709 | A1 * | 12/2017 | Mock | F41A 9/71 |

* cited by examiner

*Primary Examiner* — John W Eldred
(74) *Attorney, Agent, or Firm* — Dekel Patent Ltd.; David Klein

(57) ABSTRACT

An assembly for a firearm includes a magazine well with an adjustable inner volume for accepting magazines of different projectile calibers.

2 Claims, 1 Drawing Sheet

ADJUSTABLE MAGAZINE WELL

FIELD OF THE INVENTION

The present invention relates generally to firearms and firearm grips, and particularly to a magazine well with an adjustable inner volume for accepting magazines of different projectile calibers.

BACKGROUND OF THE INVENTION

As is well known in the art, firearms and handguns come in a variety of manufactured sizes, e.g., some referred to as full-size, compact and sub-compact. Hand grips for such weapons are often ergonomically formed of materials which are easy to grip, some of which are even compressible, to allow the user to better grasp the firearm handle. The grips often include a front strap, side panels and a back strap.

Many handguns have a magazine well in the grip for inserting therein a magazine that contains rounds of ammunition. Magazines are manufactured in different sizes in accordance with the size of the handgun as well as in accordance to the number of rounds that the magazine holds, such that the floor plate of the magazine is generally flush with the bottom of the grip.

In general, a particular handgun is designed to operate with a unique projectile caliber, such as but not limited to, 9 mm or .22 or .45. If a shooter wishes to change from one caliber to another, the shooter must use a different handgun for each different caliber.

SUMMARY OF THE INVENTION

The present invention seeks to provide a novel assembly for a firearm that includes a magazine well with an adjustable inner volume for accepting magazines of different projectile (cartridge) calibers, as is described more in detail hereinbelow.

The assembly includes a receiver, which may be a so-called 80% frame that is, it has a magazine well, trigger guard, and the receiver is fashioned to accept a slide, barrel and action (e.g., trigger, sear, hammer, etc., for stripping a cartridge from a magazine inserted in the magazine well and firing a bullet from the cartridge). The assembly may also include a kit of parts for building a complete firearm (e.g., slides, barrels, actions parts and the like).

One of the advantages of the invention is that a shooter normally is used to a particular grip and distance from the back strap of the grip to the trigger. In the prior art, when switching from one caliber to another, the shooter is forced to switch to an entirely different handgun, which may have a different grip and/or distance from the back strap of the grip to the trigger, which can be annoying or uncomfortable for the shooter, or may require the shooter to get used to a different grip. In the present invention, there is no need to get used to a different grip—the exact same receiver is used for all different calibers with the exact same grip and distance from the grip to the trigger. The user only has to change the action and upper parts (e.g., slide, barrel, etc.). This can also have the advantage of saving money on buying an entirely different handgun.

There is also a huge saving to the manufacturer, because one can use one mold for two calibers and decide just before assembly if the weapon will be 9 caliber or 45 caliber, for example.

There is provided in accordance with a non-limiting embodiment of the present invention an assembly for a firearm including a receiver including a trigger guard and a grip, the grip having a magazine well formed therein, wherein the magazine well has an adjustable inner volume for accepting magazines of different projectile calibers.

In accordance with a non-limiting embodiment of the present invention the magazine well includes a removable insert, wherein when the insert is inserted in the magazine well, the magazine well has a first inner volume and when the insert is removed from the magazine well, the magazine well has a second inner volume greater than the first inner volume.

In accordance with a non-limiting embodiment of the present invention the removable insert includes a surface received along one inner surface of the magazine well.

In accordance with a non-limiting embodiment of the present invention the removable insert includes a plurality of surfaces received along a plurality of inner surfaces of the magazine well.

In accordance with a non-limiting embodiment of the present invention the magazine well includes a movable/removable inner wall.

In accordance with a non-limiting embodiment of the present invention a cam is coupled to the movable inner wall, wherein movement of the cam moves the movable inner wall from one position to another.

In accordance with a non-limiting embodiment of the present invention a kit is provided with slides, barrels or action parts for assembly with the receiver.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
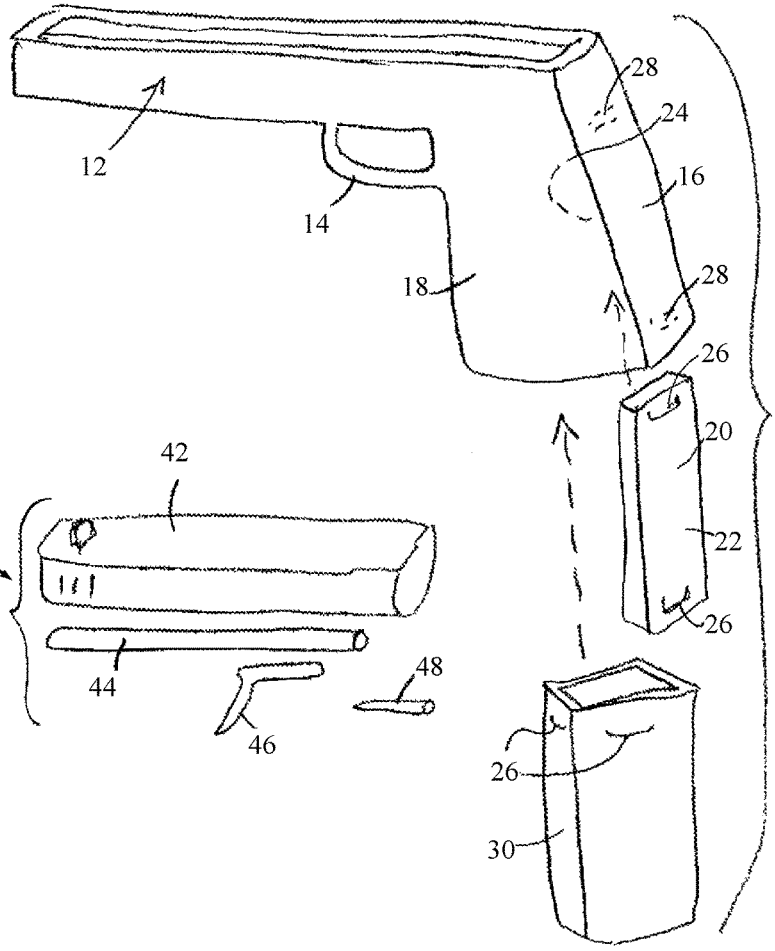
FIG. 1 is a simplified pictorial illustration of an assembly for a firearm having an adjustable magazine well, constructed and operative in accordance with a non-limiting embodiment of the present invention.
Figure 2:
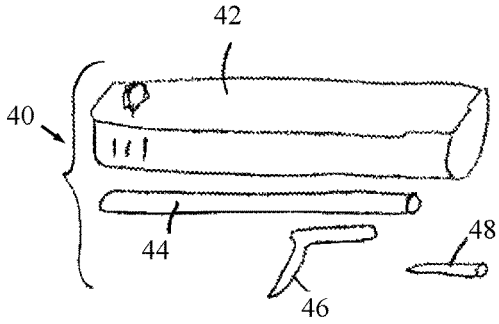
FIG. 2 is a simplified pictorial illustration of parts for a kit for assembling with the assembly of FIG. 1.

Reference is now made to FIG. 1, which illustrates an assembly 10 for a firearm having an adjustable magazine well, constructed and operative in accordance with a non-limiting embodiment of the present invention.

The assembly 10 includes a receiver 12 including a trigger guard 14 and a grip 16. The grip 16 has a magazine well 18 formed therein. The magazine well 18 has an adjustable inner volume for accepting magazines of different projectile (cartridge) calibers.

In one embodiment, magazine well 18 includes a removable insert, such as a plate member 20 that has a surface 22 received along one inner surface 24 of magazine well 18. When the insert 20 is inserted in magazine well 18, magazine well 18 has a first inner volume and when insert 20 is removed from magazine well 18, magazine well 18 has a second inner volume greater than the first inner volume. For example, the insert 20 may be sized so the first inner volume can accept a magazine with .22 caliber cartridges and the second volume can accept a magazine with .45 caliber cartridges.

The removable insert 20 may include one or more catches 26 that couple with one or more corresponding mating members 28 in magazine well 18 for securing insert 20 in magazine well 18.

In accordance with another non-limiting embodiment of the present invention, instead of a plate member, the removable insert may include a multi-sided (such as four sides) member 30, which has a plurality of surfaces received along a plurality of inner surfaces of the magazine well 18.

Figure 3A:
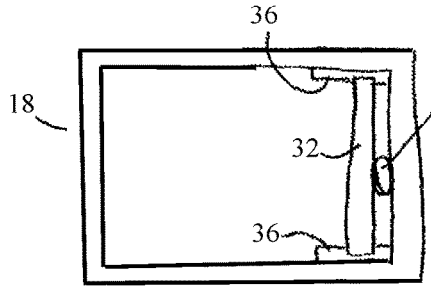
FIGS. 3A and 3B are simplified bottom-view illustrations of an adjustable magazine well, respectively before and after moving a movable inner wall in the magazine well with a cam, in accordance with a non-limiting embodiment of the present invention.
Figure 3B:
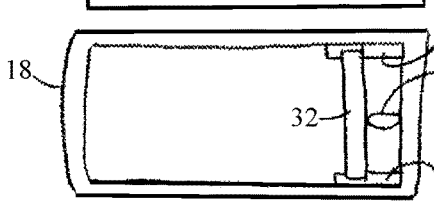

Reference is now made to FIGS. 3A-3B. In accordance with a non-limiting embodiment of the present invention, the magazine well 18 includes a movable and/or removable inner wall 32. A cam 34 is coupled to the movable or completely removable out in the same direction like the magazine itself. The plate/inner wall can be inserted between two slots in inner wall 32. Movement of the cam 34 (such as by rotating the cam with a tool, such as a screwdriver) moves the movable inner wall 32 from one position to another to create either the first or second inner volume. The movable inner wall 32 may move along one or more tracks 36.

In accordance with a non-limiting embodiment of the present invention a kit 40 is provided with one or more slides 42, barrels 44 or action parts (e.g., trigger 46, hammer 48, etc.) for assembly with the receiver 12.

What is claimed is:

1. An assembly for a firearm comprising:

a receiver comprising a trigger guard and a grip, said grip having a magazine well formed therein, wherein said magazine well has an adjustable inner volume for accepting magazines of different projectile calibers, wherein said magazine well comprises a movable inner wall.

2. The assembly according to claim 1, comprising a cam coupled to said movable inner wall, wherein movement of said cam moves said movable inner wall from one position to another.

* * * * *